US005351065A

United States Patent [19]

Killinger

[11] Patent Number: 5,351,065

[45] Date of Patent: Sep. 27, 1994

[54] INDICATOR DEVICE

[75] Inventor: Erich Killinger, Gaggenau, Fed. Rep. of Germany

[73] Assignee: Dambach-Werke GmbH, Fed. Rep. of Germany

[21] Appl. No.: 23,801

[22] Filed: Feb. 22, 1993

Related U.S. Application Data

[63] Continuation-in-part of Ser. No. 731,057, Jul. 16, 1991, abandoned.

[30] Foreign Application Priority Data

Jul. 17, 1990 [DE] Fed. Rep. of Germany ..... 4022649

[51] Int. Cl.[5] ..... G09G 3/16

[52] U.S. Cl. ..... 345/109; 345/84; 40/474

[58] Field of Search ..... 345/30, 31, 55, 84, 345/108, 109, 111; 40/474, 449, 446, 447, 450

[56] References Cited

U.S. PATENT DOCUMENTS 4,106,231 8/1978 MacNiel .
4,794,391 12/1988 Costa et al. .
4,833,806 5/1989 Gars .
5,021,773 6/1991 Browne .
5,055,832 10/1991 Browne .

FOREIGN PATENT DOCUMENTS 36086 12/1988 Austria .
3812418 10/1989 Fed. Rep. of Germany .
2051447 1/1981 United Kingdom .

*Primary Examiner*—Ulysses Weldon
*Assistant Examiner*—Matthew Luu
*Attorney, Agent, or Firm*—Speckman, Pauley & Fejer

[57] ABSTRACT

An indicator device for an indicator formed of individual indicator elements, having an optical fiber with a corresponding bore in an indicator board located in front of the indicator elements for each indicator element. Switching elements are disposed between the ends of the optical fibers and the corresponding bores of the indicator board, each said switching element corresponding to an individual optical fiber. The switching elements are selectively brought into a non-indicating position by electromagnets, where they cover the end of the assigned optical fibers, or into an indicating position, where the optical fiber is uncovered. This indicator device is utilized for displaying arbitrary luminous signals whereby each optical fiber is closed off by a reflecting body which extends into an indicator board and which is held in a hole in the bottom of the indicator compartment.

8 Claims, 2 Drawing Sheets

INDICATOR DEVICE

This application is a continuation-in-part of U.S. patent application Ser. No. 07/731,000, now abandoned.

This invention relates to an indicator device for an indicator formed of individual indicator elements in which an optical fiber with a corresponding bore in an indicator board located in front of the indicator elements is assigned to each indicator element. Switching elements disposed between the ends of the optical fibers and the corresponding bores of the indicator board are assigned to the individual optical fibers. The switching elements can be selectively brought into a non-indicating position by electromagnets, in which position they cover the end of the assigned optical fibers, or into an indicating position, in which position the optical fiber is uncovered.

2. Description of the Prior Art

An indicator device of this type is known from Austrian patent disclosure AT 36 086E in which the optical fiber is held by a U-shaped strap, in the lateral legs of which a cover, which is pivotable out of the area of the strap, is pivotably seated. In the non-indicating position the cover closes the corresponding bore in the indicator board. Such a design of the individual indicator elements requires a large amount of space, particularly next to the strap. Furthermore, the indicator elements are not clearly separated from one another, which results in a deterioration of the contrast between light and dark of the indicator elements.

An optical fiber luminous signal device is known from German patent disclosure DE 38 12 418 A1, in which the ends of individual optical fibers of a bundle are directly inserted into the bores of an indicator board and form indicator elements. Such an indicator device is only suitable for changing signs.

SUMMARY OF THE INVENTION

It is an object of this invention to provide an indicator device of the type previously mentioned, in which the indicator elements are switchable and which has a very high contrast between the indicating position, that is, light, and the non-indicating position, that is dark.

This object is attained in accordance with one embodiment of this invention in which each optical fiber is closed off by a reflecting body which extends into a compartment of a housing open in the direction of the indicator board and which is held in a hole in the bottom of the compartment. A switch element is formed by a flap, which is rotatably seated with its rotational axis in the area of the open side of the compartment and which covers the open side of the compartment in the non-indicating position. The reflecting body is positioned outside of the rotational axis of the flap and is used laterally as a stop for limiting the rotational movement of the flap to approximately 90°. Approximately one half of the flap is pivoted into the compartment in the indicating position, so that the end of the reflecting body is uncovered. A light collector is fixed in the corresponding bore of the indicator board. The light collector is formed as a section of a solid body made of glass or a transparent plastic material and at least the face facing the reflecting body is polished.

The compartments of the housing enclose all of the reflecting bodies except for the open side facing the indicator board, so that the indicator elements are clearly separated. In the non-indicating position the flap closes the corresponding compartment and in the indicating position the light collector fixed in the indicator board collects the light emitted from the uncovered reflecting body, providing a very high degree of contrast between light and dark.

In accordance with a preferred embodiment of this invention, the compartments of the housing have approximately square cross sections, and the flaps are rotatably seated with their rotational axes approximately diagonally in respect to the compartments. In order to permit the use of conventional optical fibers it is preferred that the cross section of the reflecting bodies and the light collectors be round.

The indicator device is set up in such a way that the compartments of the housing, together with the reflecting bodies fixed therein and the corresponding light collectors of the indicator board are arranged matrix-like in lines and columns.

To simplify the insertion of the light collectors in the indicator board, in accordance with another embodiment of this invention, both faces of the light collectors are polished and terminate approximately flush with the respective facing sides of the indicator board. Thus, the light collector can be inserted into the bore of the indicator board in any position because, as required, the front of the light collector facing the reflecting body is always a polished face.

The setting of the indicator elements, that is, placement into the indicating position, is accomplished in accordance with one embodiment of this invention in which electromagnets of the flaps, which are arranged in lines and columns, are temporally controllable in succession, whereby the flaps are brought into the indicating position. The lines are cyclically selected and each of the columns is cyclically controlled by setting pulses in a pre-set direction of flow in the course of each line actuation. The shut-off of the indicator elements, that is setting of the non-indicating position to erase a display, is accomplished by the electromagnets of the flaps, which are arranged in lines and columns, being temporally controlled in succession, whereby the flaps are brought into the non-indicating position. The lines are cyclically selected and each of the columns is cyclically controlled by restoring pulses in an opposite direction of flow in the course of each line actuation.

The bistable behavior of the indicator elements is attained whereby the flaps are maintained in the indicating or non-indicating position by the appropriate residual magnetism of the corresponding electromagnets.

This invention will be described in detail by means of an exemplary embodiment shown in the drawings.

DESCRIPTION OF PREFERRED EMBODIMENTS

Figure 1:
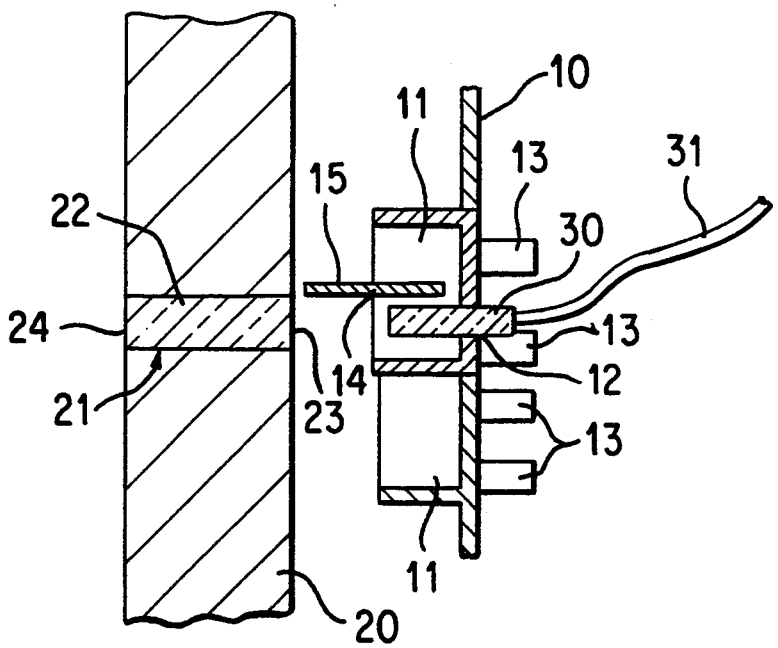
FIG. 1 is a partial sectional view of an indicator element of a matrix-like indicator device in accordance with one embodiment of this invention in the indicating position.
Figure 2:
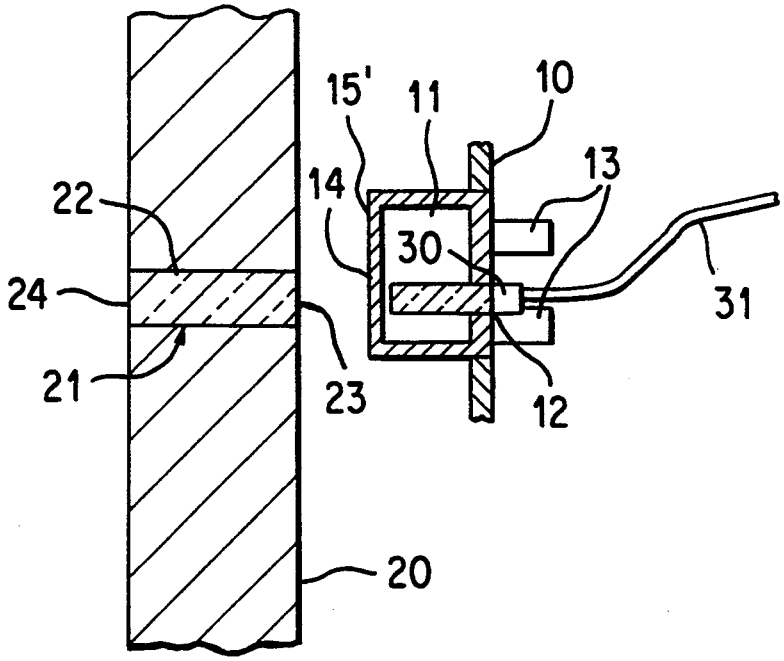
FIG. 2 is a partial sectional view of an indicator element of a matrix-like indicator device in accordance with the embodiment shown in FIG. 1 in the non-indicating position.
Figure 3:
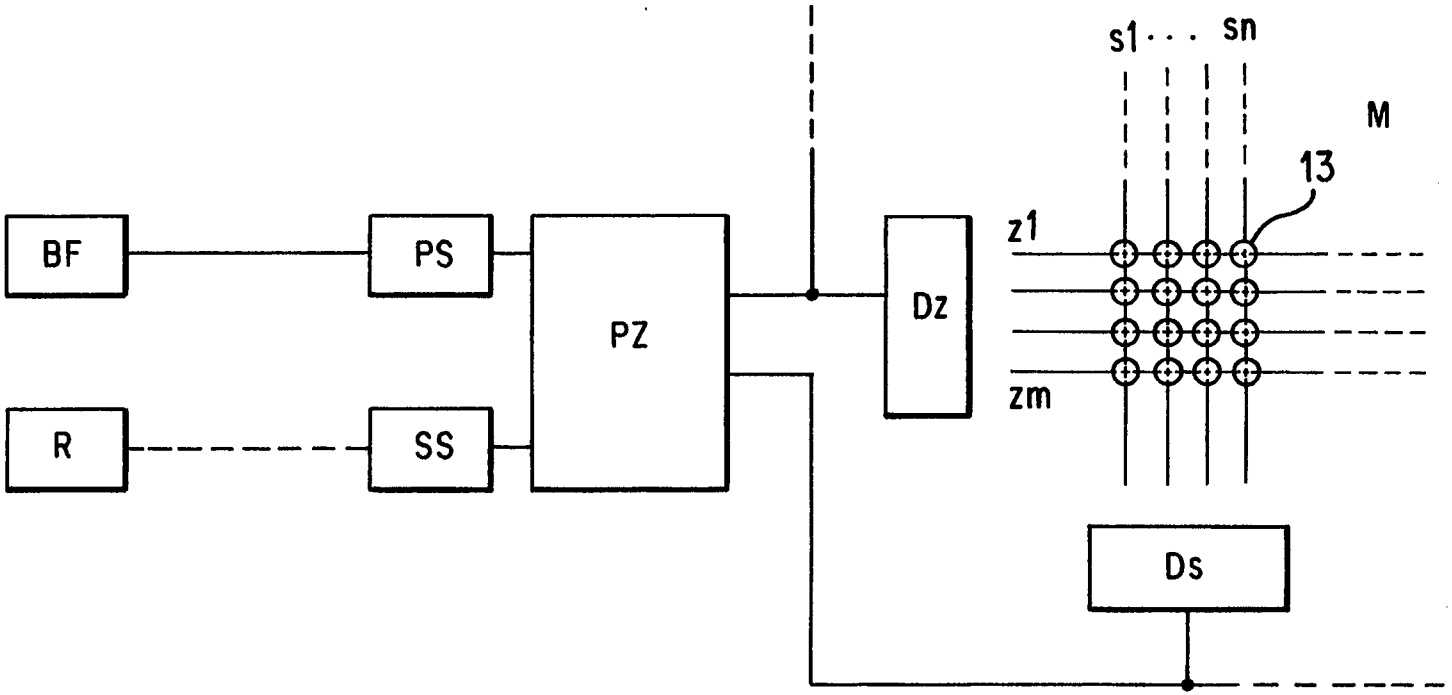
FIG. 3 is a schematic diagram of a control circuit for the indicator device in accordance with one embodiment of this invention.

The indicator device in accordance with one embodiment of this invention comprises a housing 10 for the rotational seating of flaps 15, as shown in FIG. 1. This housing 10 comprises a plate, which has in the direction towards the indicator board 20 indicator compartments 11 of square cross section, the walls of which are formed on the plate. In accordance with another embodiment of this invention, housing 10 comprises a plurality of joined partial housings in order to obtain a matrix-like indicator device of sufficient size. The indicator compartments 11 are arranged in lines and columns. A flap 15 is rotatably seated around a rotational axis 14 in every required indicator compartment 11 such that, in the non-indicating position illustrated in FIG. 2, this flap 15 covers the corresponding indicator compartment 11. A bore 12 is disposed in the bottom of the indicator compartment 11, into which a reflecting body 30 placed on the end of an optical fiber 31 is inserted. The bore 12 is designed in such a way that the reflecting body 30 is maintained therein by a snug and/or press fit and extends into the corresponding indicator compartment 11. In accordance with one embodiment of this invention, the reflecting body 30 is located outside of the rotational axis 14 of the flap 15, which rotational axis 14 preferably extends diagonally in the indicator compartment 11 and is disposed in the area of the open side of the indicator compartment 11. Behind the indicator compartment 11, a pair of electromagnets 13, corresponding to the flap 15, is disposed on the outside of the bottom, that is the plate, by which the indicating and non-indicating positions of the flap 15 are set. In the indicating position shown in FIG. 1, however, the flap cannot turn around more than 180°.

The reflecting body 30 laterally forms a stop for the flap 15, so that the latter can turn only over approximately 90°, releasing the light coming from the reflecting body 30 and permitting it to be transmitted to a light collector 22 having faces 23 and 24, which light collector 22 is fixed in front of the reflecting body 30 in an indicator board 20. The distance of the indicator board 20 from the housing 10 is selected in such a way that the flaps 15 can assume the indicating position shown in FIG. 1. The light collectors 22 are round in cross section and are in the form of sections of a glass rod or a transparent plastic rod. At least the faces 23 oriented towards the reflecting bodies 30 are polished in order to obtain a sufficient collecting effect. To simplify assembly, the faces 24 of the light collectors 22 on the viewing side, that is, the indicating side, are also polished. In accordance with one embodiment of this invention, the faces 23 and 24 of the light collectors 22 terminate approximately flush with the facing sides of the indicator board 20. The indicator board 20 is provided with bores 21, which receive and maintain the light collectors 22 in a snug and/or press fit.

The electromagnets 13 are embodied as pairs and have residual magnetism, so that the respectively set position of the flaps 15 is maintained until ordered into the other position. Accordingly, a pair of electromagnets is assigned to each indicator compartment 11, and thus each flap 15. One of the electromagnets 13 of the pair, is used for setting and maintaining the indicating position shown in FIG. 1, while by excitation of the other of electromagnets 13 of the pair, the flaps 15 are brought into and maintained in the non-indicating position shown in FIG. 2. In the non-indicating position the flaps 15 close off the corresponding indicator compartments 11, where one of the sidewalls of the indicator compartment 11 is used as a stop. The illuminated optical fiber 31 with the reflecting body 30 is covered in this case, so that no light can reach the corresponding light collector 22 in front of it. As a result, the face 24 of the light collector 22 on the viewing side remains absolutely dark, producing a very high degree of contrast between the indicating position and the non-indicating position of the flap 15 at the light collector 22.

In accordance with one embodiment of this invention, the indicator device is constructed in matrix form M, where the flaps 15 with the electromagnets 13 are arranged in lines z1 to zm and columns s1 to sn. Wiring comprises a printed circuit board, on which the housing 10 is placed with connections for the electromagnets 13, and soldered. The setting coils of the pairs of electromagnets 13 form a setting matrix, while the restoring coils of the pairs of electromagnets 13 form a restoring matrix.

Control is accomplished by a processor PZ, which successively selects the lines z1 to zm using a line decoder DZ and controls a column decoder DS in such a way that the columns s1 to sn are cyclically activated in succession in the course of each line activation. All flaps 15 required for a display are brought into the indicating position shown in FIG. 1 in this manner. A pulse control is sufficient, because the switching devices of the indicator points are bistable.

Control of the restoring matrix takes place in the same way. It is possible to decouple the setting coils and restoring coils of the electromagnets 13 of a pair through opposed diodes, switching them parallel and in this way set. and restore the flaps 15 in a common matrix M with control pulses of opposing polarity.

The processor PZ in this case receives the information regarding the desired display in a parallel technique by a control panel BF and a parallel circuit PS or in a series technique by a computer R and a series control SS.

I claim:

1. In an indicator device for an indicator formed of individual indicator elements, having an optical fiber with a corresponding bore in an indicator board located in front of the indicator elements for each of the indicator elements, a plurality of switching elements positioned between the ends of the optical fibers and the corresponding bores of the indicator board, each of said switching elements corresponding to the individual optical fibers, said switching elements selectively brought by a plurality of electromagnets into one of a non-indicating position, where they cover the end of the corresponding optical fibers, and an indicating position, where the optical fiber is uncovered, the improvement comprising:

each said optical fiber (31) closed off by a reflecting body (30), a housing (10) comprising a plate and a plurality of walls extending from a surface of said plate and forming a plurality of indicator compartments (11) approximately square in cross-section and open in a direction toward the indicator board (20), each said reflecting body (30) extending into each of said indicator compartments (11) through a bore (12) formed by the plate in each of said indicator compartments (11), the switch elements comprising a flat flap (15), rotatably seated with a rotational axis (14) in an area of said open side of the indicator compartment (11) which in a non-indicating position is pivoted into the plane of the open side, covering the open side of the indicator compartment (11) and, together with the walls and the plate of the housing (10), enclosing the reflecting body (30) within the indicator compartment (11), the reflecting body (30) disposed outside of the rotational axis (14) of the flat flap (15) and used laterally as a stop for limiting a rotational movement of the flat flap (15) to approximately 90°, about one half of said flap (15) being pivoted into the indicator compartment (11) in an indicating position, uncovering an end of the reflecting body (30), and a light collector (22) fixed in a corresponding bore (21) of the indicator board (20), said light collector (22) comprising a section of a solid body made of one of glass or a transparent plastic material and having at least a first face (23) facing the reflecting body (30) which is polished.

2. In an indicator device in accordance with claim 1, wherein the flaps (15) are rotatably seated with rotational axes (14) approximately diagonally to the indicator compartments (11).

3. In an indicator device in accordance with claim 1, wherein a cross section of the reflecting body (30) and of the light collector (22) is round.

4. In an indicator device in accordance with claim 1, wherein the indicator compartments (11) of the housing (10) with the reflecting bodies (30) fixed therein and the corresponding light collectors (22) of the indicator board (20) are arranged as a matrix in lines and columns.

5. In an indicator device in accordance with claim 1, wherein said first face and a second face of the light collectors (22) are polished and terminate approximately flush with the respective facing sides of the indicator board (20).

6. In an indicator device in accordance with claim 4, wherein for setting a display, the electromagnets (13) of the flaps (15), arranged in lines and columns, are temporally controlled in succession, whereby the flaps (15) are brought into the indicating position, where the lines are cyclically selected and each of the columns is cyclically controlled by setting pulses in a pre-set direction of flow in a course of each line actuation.

7. In an indicator device in accordance with claim 6, wherein for erasing the display, the electromagnets (13) of the flaps (15), arranged in lines and columns, are temporally controlled in succession, whereby the flaps (15) are brought into the non-indicating position, where the lines are cyclically selected and each of the columns is cyclically controlled by restoring pulses in an opposite direction of flow in the course of each line control.

8. In an indicator device in accordance with claim 1, wherein the flaps (15) are maintained in one of the indicating position and the non-indicating position by an appropriate residual magnetism of the corresponding electromagnets (13).

* * * * *